US008808147B2

(12) United States Patent
Gillespie et al.

(10) Patent No.: US 8,808,147 B2
(45) Date of Patent: Aug. 19, 2014

(54) EXERCISE DEVICE FOR PULL UPS

(76) Inventors: Jeff Gillespie, Fort Lauderdale, FL (US); Dominic Tenuta, Martha's Vineyard, MA (US)

( * ) Notice: Subject to any disclaimer, the term of this patent is extended or adjusted under 35 U.S.C. 154(b) by 461 days.

(21) Appl. No.: 13/205,811

(22) Filed: Aug. 9, 2011

(65) Prior Publication Data

US 2013/0040784 A1 Feb. 14, 2013

(51) Int. Cl.
*A63B 1/00* (2006.01)
*A63B 21/16* (2006.01)
*A63B 23/12* (2006.01)

(52) U.S. Cl.
CPC ..... *A63B 1/00* (2013.01); *A63B 21/1636* (2013.01); *A63B 2210/50* (2013.01); *A63B 23/1218* (2013.01)
USPC ..... 482/39; 482/37; 482/38; 482/40; 482/41

(58) Field of Classification Search
CPC ..... A63B 23/1218; A63B 1/00; A63B 23/12; A63B 21/1627; A63B 21/1645; A63B 21/1492; A63B 21/04
USPC ..... 482/23, 34–42, 140–148, 92–96, 131; D21/662
See application file for complete search history.

(56) References Cited

U.S. PATENT DOCUMENTS 3,915,452 A 10/1975 Winblad
4,429,912 A 2/1984 Smith
4,458,894 A 7/1984 Dudley
4,759,539 A * 7/1988 Nieppola ..... 482/36
D297,957 S 10/1988 Gordon, III
5,156,580 A * 10/1992 Holland et al. ..... 482/39
5,277,676 A * 1/1994 Holland et al. ..... 482/39
D348,706 S 7/1994 Harrell
5,417,628 A 5/1995 Vanderbleek
5,662,556 A 9/1997 Gangloff
5,776,033 A 7/1998 Brown
6,494,817 B2 12/2002 Lake
6,508,743 B1 * 1/2003 Fortin ..... 482/41
7,108,636 B1 9/2006 Garcia
7,152,614 B2 12/2006 Kalmay
7,273,443 B1 * 9/2007 Martinez et al. ..... 482/35
7,837,598 B1 * 11/2010 Boozel, Jr. ..... 482/38
8,206,273 B2 * 6/2012 Skipper ..... 482/96
D682,955 S * 5/2013 Stephan ..... D21/679
D686,286 S * 7/2013 Orakwusi ..... D21/679
(Continued)

*Primary Examiner* — Stephen Crow
*Assistant Examiner* — Andrew S Lo
(74) *Attorney, Agent, or Firm* — Jacqueline Tadros, Esq.; Jacqueline Tadros, P.A.

(57) ABSTRACT

A foldable exercise device for performing chin up and pull up exercises has a first member having a hinge joint and a second member having a hinge joint. The device also has third and fourth L shaped members connected to the first and second members, with the fourth L member being spaced from the third L member. The first and second members pivot about a hinge joint from a folded configuration to an extended configuration. The third and fourth L shaped members extend from a folded configuration to an extended configuration about their respective hinged joints. The exercise device is transformed from a compact form when the third and fourth L shaped members are moved from the folded configuration to an extended configuration in a first position and separated in a second position to extend the first and second members from a folded to an extended position.

25 Claims, 4 Drawing Sheets

(56) References Cited

U.S. PATENT DOCUMENTS

2004/0185987 A1* 9/2004 Ruzansky ..... 482/8
2005/0130806 A1* 6/2005 Lopez ..... 482/38
2005/0250619 A1* 11/2005 Daikeler et al. ..... 482/40
2007/0149369 A1* 6/2007 Finch ..... 482/140
2010/0190612 A1* 7/2010 Cook ..... 482/38
2012/0115684 A1* 5/2012 Nguyen ..... 482/40
2012/0142506 A1* 6/2012 Hetrick et al. ..... 482/142
2013/0178338 A1* 7/2013 Ross ..... 482/40

* cited by examiner

EXERCISE DEVICE FOR PULL UPS

FIELD OF THE INVENTION

The present invention is directed to a foldable exercise device. More particularly, the present invention is directed to an exercise device that can be folded for compact storage and unfolded to an extended configuration for chin-up and pull-up exercises when in use.

DESCRIPTION OF THE RELATED ART

Chin-ups or pull-ups provide a means of exercise for building muscular strength. A pull-up is an upper body compound pulling exercise wherein the body is suspended by the arms gripping something, such as a pole, and pulled up with muscular effort. As this happens, the wrists remain in neutral position, the elbows flex and the shoulders adduct and/or extend to bring the elbows to or sometimes behind the torso.

A traditional pull-up relies on upper body strength with no swinging or "kipping" or use of a forceful initial movement of the legs in order to gain momentum. The exercise often targets the latissimus dorsi muscle in the back along with many other assisting muscles.

The chin-up is a strength training exercise. People frequently do this exercise with the intention of strengthening muscles such as the latissimus dorsi and biceps, which extend the shoulder and flex the elbow, respectively. It is a form of pull up in which the range of motion is established in relation to a person's chin.

Chin-up bars are ubiquitous on playgrounds and exercise rooms. A chin-up bar is simply a smooth horizontal metal bar, often a pipe, held solidly above ground by a wooden or metal frame. Typical installations include 2 or 3 different heights of bars for people of different heights. In its common usage, a person jumps up slightly to grab the bar in both hands so that the palms are facing away (pronation) and the feet hang freely in the air. The user then pulls him or herself up to where his or her chin passes the top of the bar, slowly lowers him or herself to hanging by his arms, and repeats as many times as possible. This is referred to commonly as a pull-up. Generally, the user can stop at a maximum and minimum height for further strength training.

The chin-up can also be performed using an inverse grip, where the palms of the hands are facing the participant (supination). This is what is commonly referred to as a chin-up. This type of grip usually places more emphasis on the intercostals and the biceps, whereas the traditional grip is more of an upper-back and latissimus dorsi exercise.

Further variations on chin-ups are possible by gripping with only a few fingers of one hand in order to increase resistance on the other arm. This type of exercise should be balanced evenly on both arms. One-armed chin-ups are also possible but are notoriously difficult to achieve. Training methods for one-arm chin-ups involve exercises that emphasize concentric movements.

Chin-up exercises are a part of the U.S. President's Council on Physical Fitness program for evaluating the physical health of schoolchildren. Generally, a chin-up bar of the prior art includes a long cylindrical bar. However, this design is deficient, since the chin-up bar cannot be easily foldable for travel since the length of the chin-up bar is fixed and will not fit in a conventional travel bag. It would be advantageous in the art to have a collapsible device that can folded into a compact device for storage and travel and unfolded to expand into a full size pull-up or chin-up exercise device. Thus, a foldable device for pull ups or chin-ups is desirable for travel, moving or compact storage.

SUMMARY OF THE INVENTION

According to a first embodiment of the present disclosure, there is provided an exercise device comprising a first member having a hinged joint, a second member having a hinged joint, a third generally L shaped member being connected to the first and the second member and a fourth generally L shaped member being connected to the first and the second member and spaced from the third generally L shaped member.

The first member pivots about the hinge joint from a folded configuration to an extended configuration, and the second member pivots about the hinge joint from a folded configuration to an extended configuration.

The third generally L shaped member also includes a hinged joint and extends from a folded configuration to an extended configurations and the fourth generally L shaped member includes a hinged joint and extends from a folded configuration to an extended configuration. The third and fourth generally L shaped members are moved from the folded configuration to the extended configuration in a first position and separated in a second position to extend the first and the second members from the folded to the extended position. The exercise device is connected to a support surface in order to be used.

In a preferred embodiment, the first and the second members have different lengths and the third and fourth member are of the same size. The first through fourth members may be made from a resilient material, including a metal, plastic, thermoplastic, composite material or any other suitably resilient material that can withstand the weight of a two hundred and fifty pound person.

The first through fourth members may comprise a rectangular or circular cross section. A doorframe may support the first and the second member so a user can perform pull-up or chin-up exercises.

In yet another embodiment, the first member may comprise a hinged joint located in a middle region of the first member. The second member may also include a hinged joint in a middle region of the second member. The exercise device may include a grip portion for a user on the second member. The exercise device may also include a second grip portion on the second member. In another embodiment, the first member of the exercise device may have a spring-loaded v-shape hinged joint so that when the first member is fully extended it will tend to remain flat. In a further embodiment, the third and the fourth member are moveable toward and away from one another to extend the first and the second member.

In another embodiment of the present disclosure, there is provided a method for forming an exercise device comprising providing a first member having a hinge joint in a folded position, a second member having a hinge joint in a folded position, a third generally L shaped member having a hinge joint being connected to the first and the second member and a fourth generally L shaped member having a hinge joint being connected to the first and the second member and spaced from the third generally L shaped member. The method may include moving the third generally L shaped member from a folded configuration to an extended configuration and moving the fourth L shaped member from a folded configuration to an extended configuration.

The method further includes moving the third and fourth generally L shaped members from a folded configuration to an extended configuration in a first position and extending the first and the second members from the folded to the extended position. The method may include moving the first member to pivot about the hinge joint from a folded configuration to an extended configuration. The method also includes pivoting the second member about the hinge joint from a folded configuration to an extended configuration and supporting the exercise device on a surface.

In another embodiment, the method may also include the first and second members having different lengths and providing that the third and the fourth members are the same size. In another embodiment, the second member may be formed with a length sufficient to formulate wide grip exercises.

In one embodiment, the method may include the first member being supported by a top of a door frame while the second member rests on a lateral side of the door frame to form a supported configuration while a hand grip may be placed on the second member.

BRIEF DESCRIPTION OF THE FIGURES

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

The present invention is directed to an exercise device 5 for performing chin-ups and pull-ups and similar lifts. The exercise device 5 is preferably supported on a surface. In one aspect, the exercise device 5 can be supported on a doorframe. The support surface preferably can be any horizontal surface. However, the support surface may also be vertical. The exercise device 5 preferably is a device that can be easily folded or disassembled to fit into a small exercise bag. In two motions, namely, in pulling two generally L shaped members back and unfolding the members and then pulling the two generally L shaped members apart, the exercise device 5 can be unfolded, revealed and snap into place. The exercise device 5 can then be supported on a surface and the user can do chin-ups or pull-ups.

It should be appreciated that the present exercise device 5 may include a number of members however, the number can vary according to several embodiments of the present disclosure. Various configurations are possible and within the scope of the present disclosure. In one embodiment, the exercise device 5 may comprise eight generally straight members. In another embodiment, the exercise device 5 includes four substantially straight members and two generally L-shaped members. In yet another preferred embodiment, the exercise device 5 includes two substantially straight members and two generally L-shaped members In one embodiment, the bars are connected via a hinge joint. The hinge joint preferably includes a snap one way pivoting functionality in that when the pivot is rotated the pivot snaps and locks into place. Various locking devices may be present and can be utilized within the present disclosure as one of ordinary skill in the art can appreciate. Further, the exercise device 5 may be modified to perform additional exercises than those discussed herein.

Figure 1:
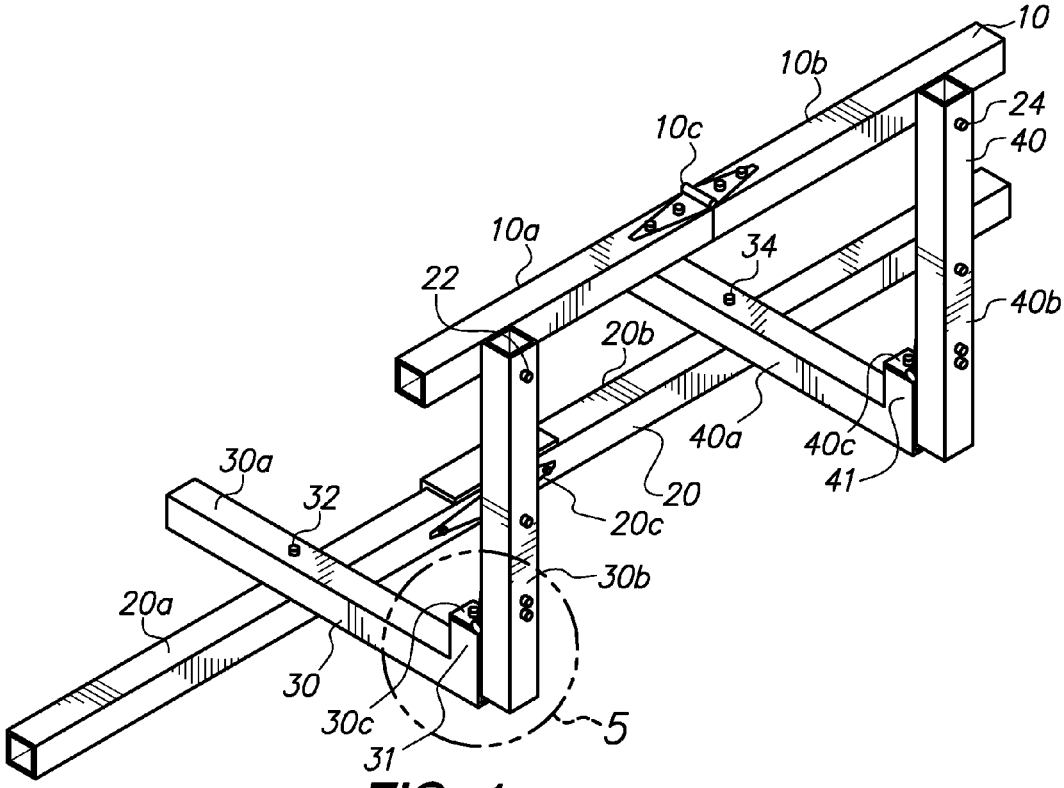
FIG. 1 shows the exercise device in a fully extended configuration.

Turning now to FIG. 1, the exercise device 5 is shown in an extended position. The exercise device 5 includes a first member 10 and a second member 20. The exercise device 5 also includes a first generally L shaped member 30 and a second generally L shaped member 40. The first member 10 includes a first portion 10*a* connected to a second portion 10*b*. The first portion 10*a* is connected to the second portion 10*b* by a locking pivoting hinge joint 10*c*. Preferably, as mentioned above, the hinge 10*c* can move and snap and lock into place. In a preferred embodiment, 10*c* is a spring hinge joint. The second member 20 also includes a first portion 20*a* connected to a second portion 20*b* by a second hinge joint 20*c*. Preferably, as with 10*c*, the second hinge 20*c* can also move and snap and lock into place.

The first generally L shaped member 30 includes a first leg portion 30*a* connected to a second leg portion 30*b* via a third hinge 30*c*. The second generally L shaped portion 40 includes a block member 41, a first leg portion 40*a* connected to a second leg portion 40*b* via a fourth hinge 40*c*. The dimensions of L shaped members 30 and 40 are substantially identical. Similarly, the dimensions of 30*b* mirror those of 40*b* and the dimensions of 30*a* mirror those of 40*a*.

As can be seen, the second member 20 is connected at a first point with the first generally L shaped member 30 and at a second point with the second generally L shaped member 40. Also, the first member 10 is connected at a first and second point to the first and the second L shaped members 30 and 40.

Preferably, the second member 20 is connected to the first and second L shaped members 30 and 40 via rotatable pins 32 and 34. Likewise, the first member 10 is connected to the first and second L shaped members 30 and 40 via rotatable pins 22 and 24. As can be seen the device 5 includes first and second members 10 and 20. Member 10 is utilized to support the exercise device 5 on a support surface. Member 20 is utilized by the user as a gripping member to perform chin-up or pull-up exercises. Member 20 may further include a comfortable covering disposed thereon so the user's hands do not chafe (not shown). In another embodiment, the device 5 may further comprise a compartment for chalking the hands (not shown). In yet a further embodiment, the device 5 may include a wide end grip member at the first end of the second member and a wide end grip member at the second end of the second member (not shown). Various configurations are possible and within the scope of the present disclosure.

Figure 4:
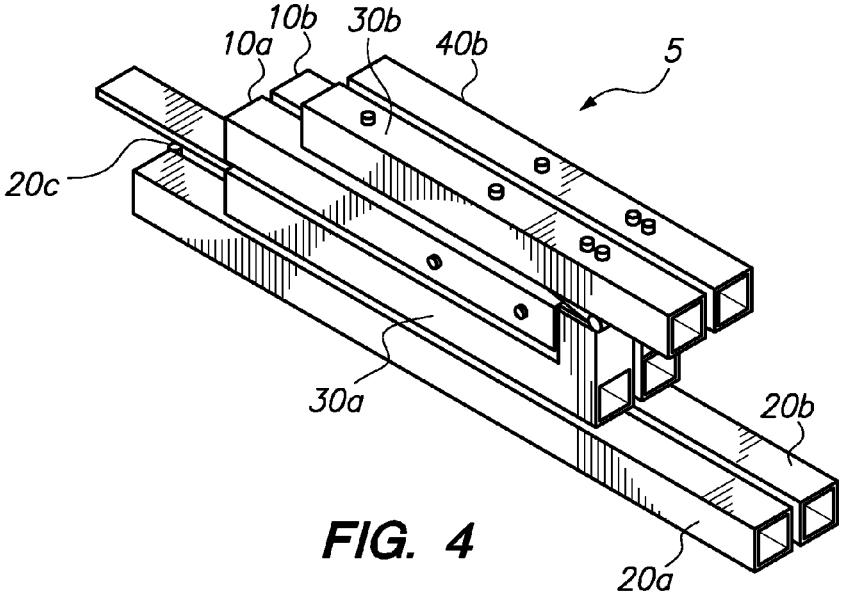
FIG. 4 shows the exercise device in a folded configuration.

Turning now to FIG. 4 there is shown an exercise device 5 in a folded configuration for travel or storage. As can be seen, in its folded position, the exercise device 5 forms a number of elongated members disposed in a generally parallel configuration relative to one another. In its folded position, the device 5 is compact and can be stored in a bag, or stowed away for travel.

The exercise device 5 includes from a top down the first generally L shaped member portion 30*b* and the second generally L shaped portion 40*b*, in a side by side parallel configuration relative to one another; followed by the first elongated member 10*a* and 10*b* in a side by side parallel configuration relative to one another; followed by members 30*a* and 40*a* in a side by side parallel configuration relative to one another and then finally members 20*a* and 20*b* in a side by side parallel configuration relative to one another, are on the bottom. Generally, the L shaped members 30 and 40 fold about ninety degrees relative to the pivots 30*c* and 40*c* as shown. Also, the first elongated member 10 is also folded so the first portion 10*a* and the second portion 10*b* fold about pivot portion 10*c*. Finally, the second elongated member 20 also is folded so the first portion 20*a* and the second portion 20*b* fold about the pivot portion 20*c*.

As shown in FIG. 4, when the exercise device 5 is in a closed or folded configuration, 30*b* and 40*b* are positioned side by side, parallel to one another. Similarly, when exercise device 5 is in a closed or folded configuration, members 10*a* and 10*b* are positioned side by side, parallel to one another and contiguous to members 30*b* and 40*b*. Members 30*a* and 40*a* are positioned side by side, parallel to one another and contiguous to members 10*a* and 10*b* and members 20*a* and 20*b*. Thus, when exercise device 5 is folded, the members of elongated bars 10 and 20 are similarly folded at their respective mid point regions, namely 10*c* and 20*c*, such that members 10*a* and 10*b* and members 20*a* and 20*b* are side by side and parallel.

In contrast, when exercise device 5 is folded, L shaped members 30 and 40 collapse such that members 40*b* and 30*b* are positioned side by side, parallel to one another and members 40*a* and 30*a* are positioned side by side, parallel to one another.

Figure 2:
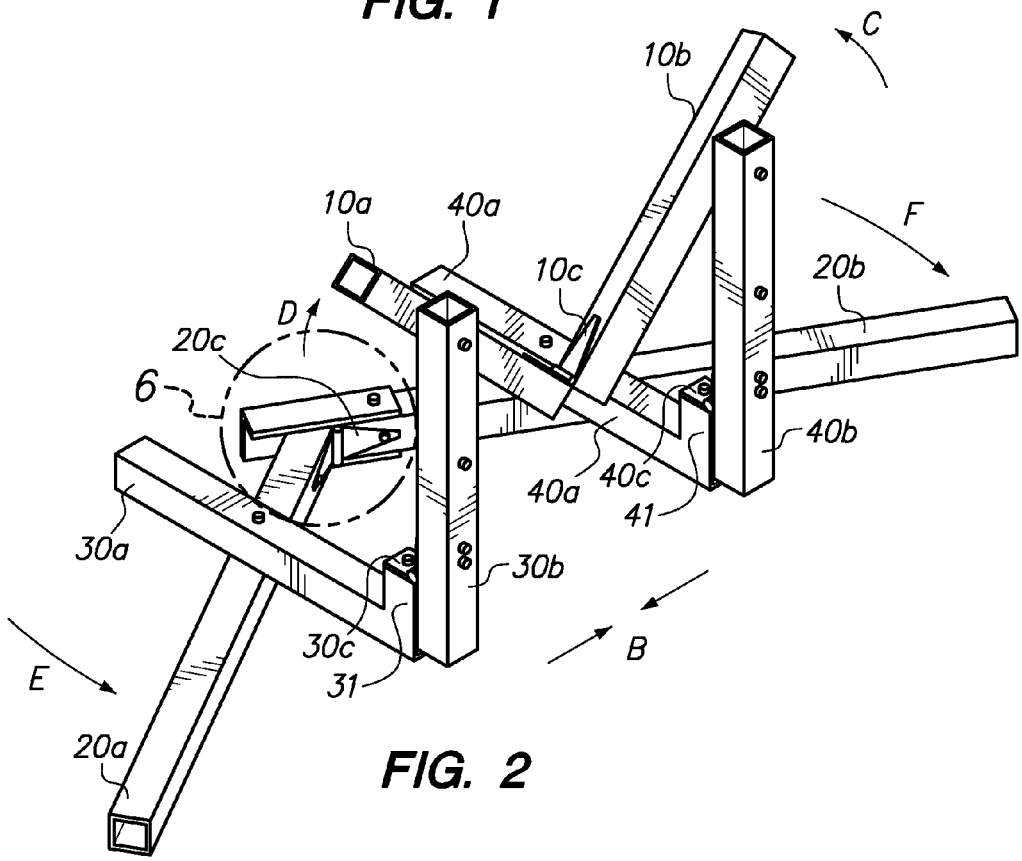
FIG. 2 shows the exercise device in a partially folded configuration with the L shaped members in an unfolded configuration and the top and lower bar members in a partially folded configuration.
Figure 3:
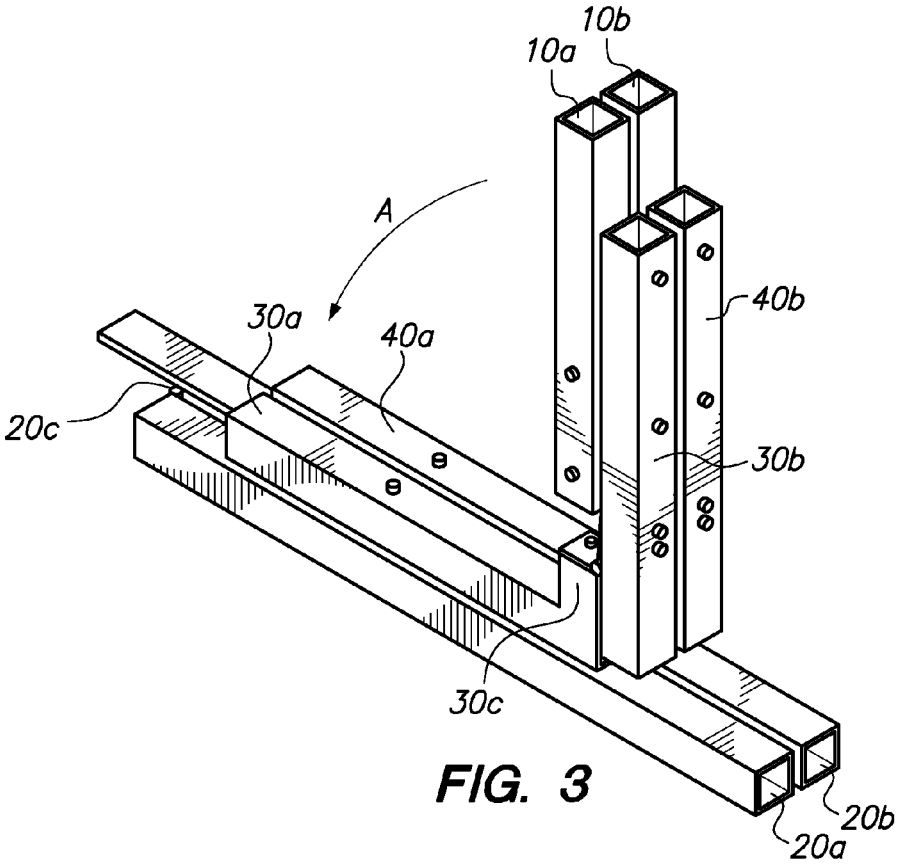
FIG. 3 shows the exercise device being further folded from the partially folded configuration shown in FIG. 2, with the L shaped members in an unfolded configuration and the top and lower bar members in a folded configuration.

Referring now to FIGS. 2-3, members 10*a* and 10*b*, and 40*b* and 30*b* are pulled in the direction of reference letter A so the first and the second generally L shaped members 30 and 40 are formed. For example, 30*b* of the first L shaped member 30 will be generally from zero degrees in FIG. 4 to ninety degrees in FIG. 3 so 30*b* is ninety degrees relative to 30*a* via pivot point at hinge joint 30*c*. The force that the user imparts to pull in the direction of reference letter A also moves 40*b* of the second L shaped member 40, which will be generally be moved from zero degrees in FIG. 4 to ninety degrees in FIGS. 1-3 so the first portion 40*b* is ninety degrees relative to the second portion 40*a* via pivot point at hinge joint 40*c* of the second generally L shaped member 40.

As can be seen in FIGS. 2-3 both the first member 10 and the second member 20 remain in the folded position even though the first and the second generally L shaped members are engaged and unfolded. It should be appreciated that movement A does not disturb the second member 20 and first members 10 is rotated but is not unfolded. Generally, the first member 10 is folded about the pivot of joint hinge 10*c* while the second member 20 is disposed in a plane that is ninety degrees relative to the first member 10 and also folded about pivot of joint hinge 20*c*.

Turning now to FIG. 3, there is shown a partially folded view of the first and the second members 10 and 20 being rotated about the respective pivot points at 10*c* and 20*c*. As can be seen, the first generally L shaped member 30 and the second generally L shaped member 40 are pulled in either direction away from one another as shown with reference arrow B. As shown, the first member 10 includes a first portion 10*a* and a second portion 10*b* that move from an abutting relationship about pivot point 10*c* to an elongated configuration. The pivot point about joint hinge 10*c* is suitable such that when elongated the first portion 10*a* becomes fixed relative to the second portion 10*b*. As shown, the pivot point 10*c* moves upwardly while the ends of the first and the second portions 10*a* and 10*b* opposite 10*c* move downwardly along reference arrows C and D to form the completed elongated member 10 shown in FIG. 1.

Now referring to FIGS. 1-4, the second member 20, which is in a different plane rotated about ninety degrees from the first member 10, the second member 20 also moves from a folded configuration to an elongated configuration. The second member 20 moves about the pivot 20*c* so the first portion 20*a* rotates about the pivot 20*c* and the second portion 20*b* also rotates about the pivot 20*c*. As shown the pivot 20*c* moves rearward, while the first and the second portions 20*a* and 20*b* move in an opposite manner relative to the pivot 20*c* to form the elongated configuration. The first portion 20*a* moves in the direction of reference arrow E and the second portion 20*b* moves in the direction of the reference arrow F.

Now turning to FIG. 1, there is shown the completed exercise device 5 in a fully extended position. As shown the first and second generally L shaped members 30 and 40 are fixed in position. Portions 30*b* and 40*b* of the generally L shaped members 30 and 40 support the first elongated member 10 in a fixed position. The first portions 30*a* and 40*a* support the second elongated member 20 in a fixed position.

As shown in FIG. 1, first member 10 and second member 20 are connected to the first generally L shaped member 30, and fixedly attached once in the exercise device 5 is in the expanded and locked position, as shown in FIG. 1. In the expanded position, portion 30*a* is fixedly connected to portion 30*b* at a ninety degree angle.

The first 10 and second members 20 are also rigidly attached to the second generally L shaped member 40, once in the exercise device 5 is in the expanded and locked position. In the expanded position, 40*a* is fixedly connected to 40*a* at a ninety degree angle.

The second generally L shaped member 40 includes a first elongated portion 40*a* and a second elongated portion 40*b* that is also rigidly connected to the first elongated portion 10 at a right angle via a rotatable pin 24. Preferably, pin 24 is high strength pin and will not break under a large load. The first and the second L shaped member 30 and 40 are separated from one another by a fixed predetermined distance that allows the members 30 and 40 to provide enough clearance and are on a first side and a second side of the exercise device 5 so a user may grip and form a chin up.

The first member 10 is connected to the first L shaped member 30 at a first location. Preferably, a rotatable pin 22 connects the first elongated member 10 to the first L shaped member 30, but an interlocking fastener may also be used. The first member 10 is connected to the second L shaped member 40 at an opposite location by a second rotatable pin 24, however other fasteners are envisioned.

The second elongated member 20 is also connected to the first L shaped member 30 at a second location by a rotatable pin 32, however this arrangement also is not limiting. The second elongated member 20 is connected to the second L shaped member 40 by a rotatable pin 34. Preferably, pins 22, 24, 32 and 34 are high strength pins and will not break under a large load.

Figure 8:
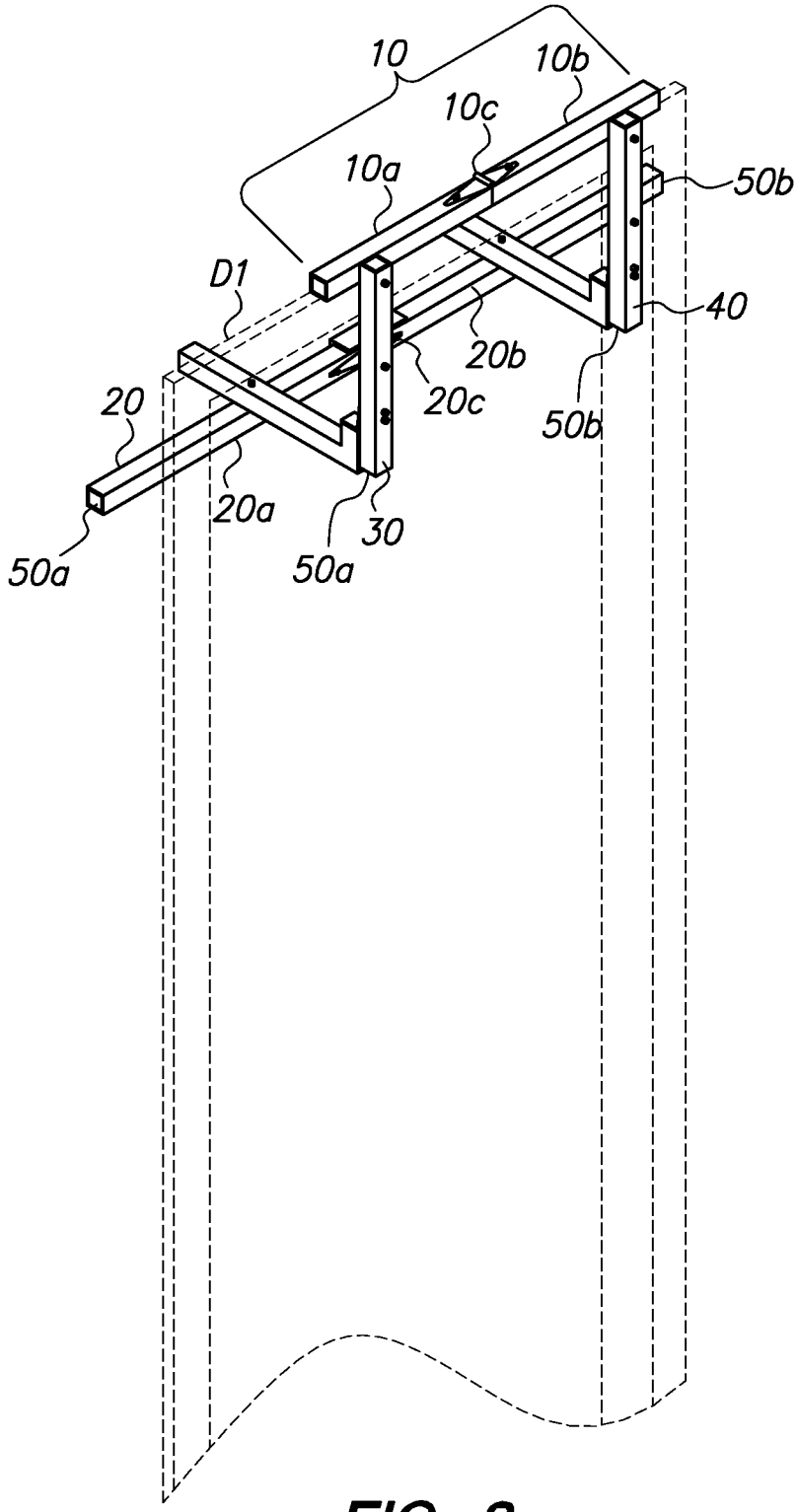
FIG. 8 shows the exercise device being supported on a doorframe.

Turning now to FIG. 8, as shown in an initial position supported on the doorframe D1, the first and second elongated members 10 and 20 are generally disposed in a parallel fashion. The first portion 30*a* and the second portion 40*a* of the first and the second L shaped members 30 and 40 are generally parallel aligned. As shown, first portion 10*a* and second portion 10*b* are supported on the door frame D1 so the user may grip the first and the second portions 20*a* and 20*b* to formulate the chin up or pull ups. In a preferred embodiment,

10*c* is a spring hinge with a v-shape connector point above the door-so that when member 10 is fully extended and in use, it tends to remain flat and open in an extended position. The spring hinge 10*c* will also assist the user when unfolding the exercise device 5, since it will facilitate the expansion by helping to release 10*a* and 10*b* and pop open member 10.

Once completed and if the user desires to remove the device 5, the first and the second L shaped members 30 and 40 are pulled in together, opposite of reference arrow B in FIGS. 2-3. The relative motion of the first and second L shaped members, 30 and 40 folds the first elongated member 10 and the second elongated member 20. The relative motion of the first and the second L shaped members 30 and 40 inward also rotates the second elongated member 20 about pivot 20*c* and folds the second elongated member 20. The exercise device 5 preferably snaps in a firm collapsed state, where the joints 10*c*, 20*c*, 30*c* and 40*c* hold the position shown in FIG. 4.

Turning now to FIG. 8, there is shown the exercise device 5 having the first elongated member 10 being supported on a door frame 5 while the second elongated member 20 is shown in a parallel arrangement. The second elongated member 20 is spaced by a predetermined distance and will hold the weight of the user. As shown in FIG. 8, first member 10 is secured to a top of the door frame as shown. Second member 20 is greater in length than member 10.

Turning again to FIG. 1, it should be appreciated that the exercise device 5 may be formed from eight discrete bar members. For example, the first member may comprise a first bar 10*a* and a second bar 10*b*. The second member may comprise a first bar 20*a* and a second bar 20*b*. The third L shaped member 30 may comprise a first bar 30*a* and a second bar 30*b*. The fourth shaped member 40 may comprise a first bar 40*a* and a second bar 40*b*. It should be appreciated that members 10, 20, 30, 40 may comprise a circular or rectangular cross section.

Figure 5:
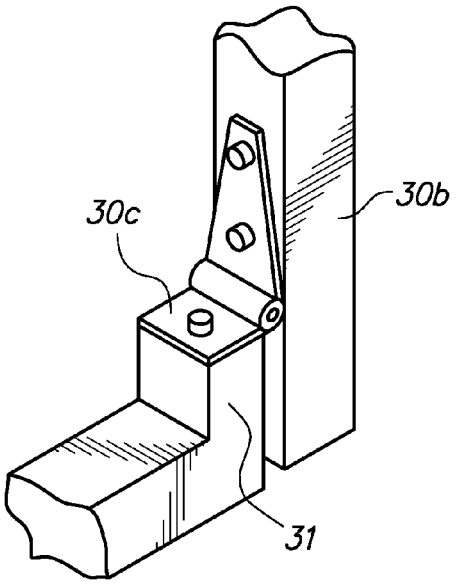
FIG. 5 is a close up of the hinge corner of an L shaped member of FIG. 1.

Turning now to FIG. 5, there is shown a close up view of the hinge corner of an L shaped member 30. Bar 30*a* includes a block member 31 and hinge 30*c* connects 30*a* and 30*b* via a joint at 30*c*.

Figure 7:
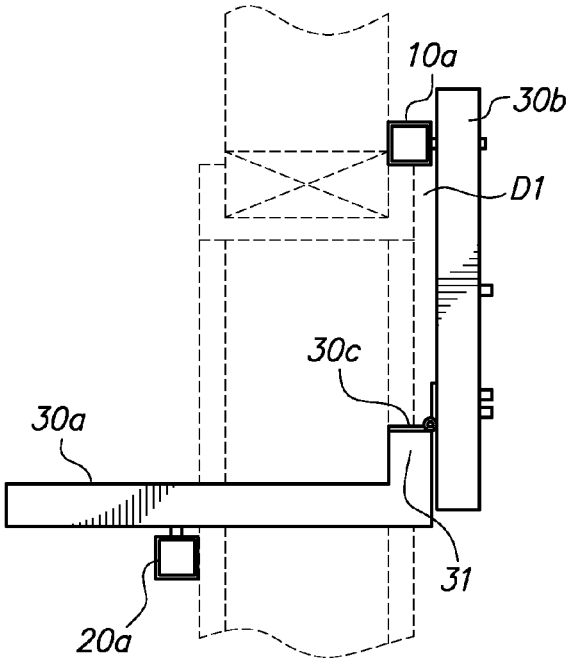
FIG. 7 is a side view of an L shaped member of FIG. 1.

FIG. 7 is a side view of L shaped member 30 in an unfolded position and connected to a doorframe at D1.

Figure 6:
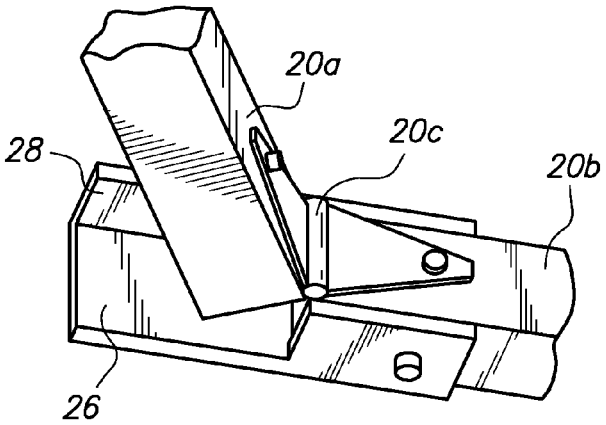
FIG. 6 is a close up of the hinge of the lower bar member shown in FIG. 2.

FIG. 6 is a close up of the hinge 20*c* of the lower bar member 20. As shown, a horizontal and vertical mating piece 26, 28 extend past the bar member 20*a*. Mating pieces 26 and 28 provide support to bar 20 along hinge portion 20*c* and reinforce the hinge joint at 20*c* when bar 20 is in the extended and unfolded position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A foldable exercise device, capable of being mounted to a door frame, for performing pull-up or chin-up exercises comprising:

a first member having a first hinge joint;

a second member having a second hinge joint;

a third generally L-shaped member being connected to the said first and second members;

a fourth generally L-shaped member being connected to said first and second members, and wherein said fourth generally L-shaped member is spaced from said third generally L-shaped member;

wherein said first member pivots about said first hinge joint from a folded configuration when compacted to an extended configuration when in use, and wherein said second member pivots about the second hinge joint from a folded configuration when compacted to an extended configuration when in use;

wherein said third generally L-shaped member includes a third hinge joint and pivots about said third hinge joint at a midpoint of said third member and extends from a folded configuration when compacted to an extended configuration when in use;

wherein said fourth generally L-shaped member includes a fourth hinge joint and extends from a folded configuration when compacted to an extended configuration when in use;

wherein said third and fourth generally L-shaped members are capable of repeatedly being moved back and forth from said folded configuration to said extended configuration in a first position and separated in a second position to extend said first and second members from the folded to the extended position; and wherein said first member provides a means for connecting said exercise device to a support surface.

2. The device of claim 1, wherein the second member includes a horizontal and a vertical mating piece positioned at a midpoint along said second hinge joint for providing support and reinforcement to the second member when it is in the extended and unfolded position.

3. The device of claim 1, wherein said third and the fourth generally L-shaped members are moveable toward and away from one another to extend the first and the second member.

4. The device of claim 1, wherein the said second member has a greater length relative to the first member.

5. The device of claim 1, wherein said third and fourth members have the same dimensions.

6. The exercise device of claim 1, wherein said first member pivots about said first hinge joint at a midpoint of said first member.

7. The device of claim 1, wherein said second member pivots about said second hinge joint at a midpoint of said second member.

8. The device of claim 1, wherein said fourth generally L-shaped member pivots about said fourth hinge joint at a midpoint of said fourth member.

9. The device of claim 1, wherein said first hinge joint of said first member is a spring hinge joint.

10. The device of claim 1, wherein said first member pivots about said first hinge joint at a midpoint of said first member; said second member pivots about said second hinge joint at a midpoint of said second member; said third generally L-shaped member pivots about said third hinge joint at a midpoint of said third member; and said fourth generally L-shaped member pivots about said fourth hinge joint at a midpoint of said fourth member, such that the first and second hinge joints are positioned at a respective midpoint of the corresponding first and second members, and the third and fourth hinge joints are positioned at a respective midpoint of the corresponding third and fourth generally L-shaped members.

11. The device of claim 1, wherein the support surface is a door frame such that said first member rests on and is supported by the door frame when said device is in use, so a user can perform pull up or chin up exercises.

12. The exercise device of claim 1, wherein the support surface is a door frame, such that the first member rests on a top of the door frame while the second member rests on an exterior lateral surface of the door frame, and wherein the user grips the second member.

13. The exercise device of claim 1, wherein a first portion of said third generally L shaped member and a first portion of said fourth generally L-shaped member are positioned side by side, parallel to one another when the exercise device is in a closed or folded configuration.

14. The exercise device of claim 1, wherein a first portion of said first member and a second portion of said first member are positioned side by side, parallel to one another when the exercise device is in a closed or folded configuration.

15. The exercise device of claim 1, wherein a first portion of said second member and a second portion of said second member are positioned side by side, parallel to one another when the exercise device is in a closed or folded configuration.

16. The exercise device of claim 1, wherein a second portion of said third generally L-shaped member and a second portion of said fourth generally L-shaped member are positioned side by side, parallel to one another when the exercise device is in a closed or folded configuration.

17. The exercise device of claim 13, wherein said first portion of said third generally L-shaped member and said first portion of said fourth generally L-shaped member are contiguous to said first portion of said first member and said second portion of said first member and said first portion of said second member and said second portion of said second member when the exercise device is in a closed or folded configuration.

18. A method for forming an exercise device comprising:

providing a first member having a first end, a second end and a first hinge joint;

providing a second member having a first end, a second end and a second hinge joint;

providing a third L-shaped member having a third hinge joint and being connected to the first and the second member;

providing a fourth L-shaped member having a fourth hinge joint and being connected to the first and the second member and spaced from the third L-shaped member;

moving the third L-shaped member and extending said third L-shaped member from a folded configuration to an extended configuration;

moving the fourth L-shaped member and extending said fourth L-shaped member from a folded configuration to an extended configuration;

moving the third and fourth L-shaped members from the folded configuration to the extended configuration in a first position;

extending the first and the second members from the folded to the extended position;

moving the first member to pivot about the first hinge joint from a folded configuration to an extended configuration;

pivoting the second member about the second hinge joint from a folded configuration to an extended configuration; and supporting the first member to a door frame and forming the first and the second members having different lengths.

19. The method of claim 18, further comprising providing that the third and the fourth members are the same size.

20. The method of claim 18, further comprising supporting the first and the second member by the door frame in at least two different locations so a user can perform pull up exercises or chin up exercises.

21. The method of claim 18, further comprising providing the first hinge joint at a midpoint of the first member.

22. The method of claim 18, further comprising providing the second hinge joint at a midpoint of the second member.

23. The method of claim 19, further comprising providing a wide end grip member at the first end of the second member and a wide end grip member at the second end of the second member.

24. The method of claim 20, further comprising providing a spring-loaded hinge at a midpoint of the first member.

25. The method of claim 24, further comprising pulling the third and fourth member away from one another to extend the first and the second member.

* * * * *